United States Patent [19]

Wallet

[11] 4,418,952

[45] Dec. 6, 1983

[54] SEAL DEVICE

[76] Inventor: Claude D. Y. Wallet, 101 Avenue Charles de Gaulle, 95160 Montmorency, France

[21] Appl. No.: 277,740

[22] Filed: Jun. 26, 1981

[30] Foreign Application Priority Data

Jun. 27, 1980 [FR] France ..... 80 14375

[51] Int. Cl.[3] ..... B65D 33/34

[52] U.S. Cl. ..... 292/327

[58] Field of Search ..... 292/319, 318, 307, 327, 292/323; 70/49, 422

[56] References Cited

U.S. PATENT DOCUMENTS

| | | | |
|---|---|---|---|
| 883,501 | 3/1908 | Swallow | 292/307 |
| 3,980,337 | 9/1976 | Moberg et al. | 292/319 |
| 3,994,521 | 11/1976 | Van Gompel | 292/319 |

*Primary Examiner*—Richard E. Moore

*Attorney, Agent, or Firm*—Austin R. Miller

[57] ABSTRACT

The technical problem of the invention concerns a seal device for guaranteeing to the addressee of containers that they have not been opened in transit.

The technical problem is to provide such a seal device which is reliable and secure.

The basis of the solution to this problem consists in the fact that the seal device comprises a body in the shape of a shank made from a metal cable (3) surrounded by a spring whose turns are close but not touching and which extends from the male ferrule (5) to the rear stop (4).

The main usage of the invention resides in a seal device applicable to the doors of wagons, trucks, trailer containers and the like.

8 Claims, 2 Drawing Figures

1
2
2₁
2₂
3
3₁
3₂
4
5
5₁
5₂
5₃
5₄
6
7
7₁
7₂
8
8₁
9

10
11.
12.
13
14
15

SEAL DEVICE

The invention relates to a seal device applicable, especially, to the locks of the doors of wagons, trucks, trailers, containers and the like, the device not being totally indestructible but being designed to guarantee to the addressee of the container that it has not been opened in transit.

The increase in thefts committed, particularly in marshalling yards, has lead to providing the wagons, or the containers transported by the wagons, with seals designed to deter thieves and robbers who frequent marshalling yards. This type of seal is not intended to be a secure lock, but rather is designed to signal the customer who receives the container or wagon that its contents correspond with what was dispatched, to the extent that the seals have not been broken.

Consequently, seal devices of this kind are formed essentially in two parts, one male and one female, which can easily be coupled without having to make use of a tool. In the known devices, the male part usually consists of a body formed from an elongated shank one of whose ends is provided with a projecting stop or head, the other end being provided with a male ferrule comprising a locking groove, the female ferrule in turn being made in the shape of a sheath which is coupled with the male ferrule, the sheath being provided with an elastic member such as a split ring or a circlips designed to lock into the groove of the male ferrule on complete coupling.

The operation of such a device is extremely simple since it is sufficient to introduce into the two eyelets of the container or wagon the male part of the device, then to lock onto this male part the female ferrule which will constitute after coupling a projecting head having a diameter at least as great as that of the fixed stop at the other end of the elongate body of the male part, this diameter obviously being greater than that of the orifices in the handles through which the male ferrule has been passed whose diameter, on the other hand, is less than that of the orifices of said handles.

A seal device is thus presented which consists in fact of an elongated body which can pass through the orifices of the handles, the two ends of this elongated body being provided, after coupling the male and female ferrules, with a protuberant head at each of these ends, preventing the withdrawal of the device.

It is also known to produce other similar seal devices, composed of a flexible material such as a cable, one of whose ends comprises a male ferrule while the other end has a female ferrule which have the features of the two ferrules described above. This kind of device can only be used in the form of a loop, because it is necessary to form a ring so as to be able to introduce the male ferrule into the female ferrule.

These seal devices present various disadvantages which the invention is intended to avoid. In particular, in the first case the seal device can be broken because of the fact that the socket forming the female member is open at one end so that it is possible for a thief to pass a tool or rod into the socket and use it as a wedge to uncouple the female member from the male member. The crime then committed, the thief can sometimes recouple the male and female ferrules to cover up his misdemeanour. Moreover, the shank forming the elongate body of the device, when made from solid steel, can easily be broken by means of successive tensions applied in opposite directions using a lever so that the seal device is particularly vulnerable to break-ins.

In the case of the second design, in which the body consists of a flexible cable forming a shank or loop, once again, the device is not entirely satisfactory because of the vulnerability of all types of cable to sectioning and cutting strand by strand using small portable shears or to cutting with very sharp pincers.

The object of the invention thus is to provide for the users of wagons or containers a substantially invulnerable seal device which, by its security features, discourages thieves. The seal device according to the invention is particularly characterised in that the elongate body is surrounded or covered by means having high mechanical rupture and shear strength. These means, by permitting the body to deform or curve, avoid breakage, which would otherwise occur if the elongated body consisted of a simple bar of steel for example.

The invention relates therefore to a seal device applicable, especially, to closure means for the doors of wagons, trucks, trailer, containers and the like, comprising a male part and a female part, said male part comprising an elongated shank presenting first and second ends, protuberant stop means at said first end for preventing withdrawal of said shank from said closure means by said first end, and a male ferrule at said second end having smaller lateral dimensions than said stop means thereby allowing insertion of said shank in said closure means by said second end, said female part presenting a socket for reception of said male ferrule, and the device including locking means for cooperating with said male ferrule and said socket to couple said male and female parts within said socket when said male ferrule is inserted in said socket, whereby said female part prevents withdrawal of said shank from said closure means, characterised in that said shank comprises a metal cable (3) and a coil spring (7) surrounding said cable from said stop means (4) to said male ferrule (5), said spring having close but non-coil bound turns.

According to a feature of the invention, the spring held between the male ferrule and the stop is in slight compression. The rear stop comprises a metal head moulded on the compacted end of the cable with the end of the spring, that is to say the last two or three turns, also being buried in the moulded metal head so that the head cannot be wrenched off.

Other features and advantages of the invention will appear from the following description and the accompanying drawings, in which.

Figure 1:
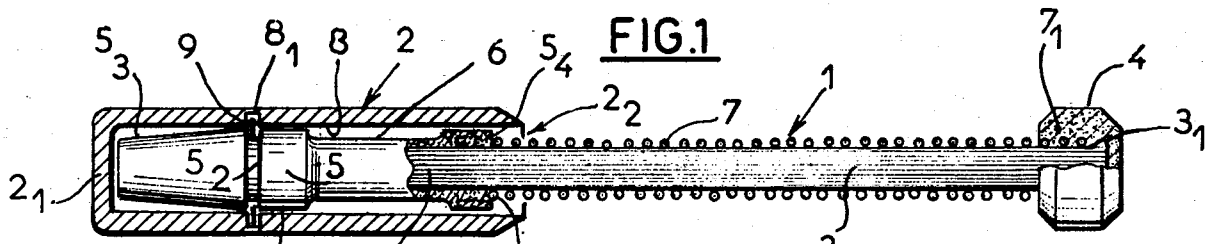
FIG. 1 is a partial sectional view of a seal device according to the invention.

As shown in FIG. 1, the device consists essentially of a male part 1 and a female part 2, capable of being coupled together by simple manual engagement and axial pressure. Coupling does not require the use of a tool.

The male part comprises an elongated body 3 which, in the embodiment shown comprises a metal cable, including at one end a stop or projecting head 4 which, in accordance with the invention is moulded onto the compacted rear end $3_1$ of the cable. This head 4 provides a stop because its diameter is considerably larger than that of the cable 3. Head 4 can be made out of zamac for example. The other end of the body 3 comprises a male ferrule 5 crimped on the end $3_2$ of the cable, the length of the crimp zone 6 being equal to two, three or four times the diameter of the cable 3. Moreover a crimp tool is chosen which gives a polygonal cross-section in the zone 6 which provides better resistance to wrenching off by pulling on the male ferrule 5. According to another feature of the invention however, the crimp is provided having a mechanical strength not greater than the rupture strength of the cable 3. A lower mechanical strength is preferable, taking one thing with another, so that during breaking in, the male ferrule 5 should give way in such a way that it stays captive in the female ferrule 2 (which will be described below) so that it is not possible to reuse the male ferrule 5 for criminal purposes. This male ferrule 5 comprises, moreover, a cylindrical part $5_1$ followed by a circular groove $5_2$, then a truncated cone part $5_3$ which forms the lead in for the male ferrule 5 into the female ferrule 2.

According to a particular feature of the invention, the cable 3 is surrounded over its whole length by a coil spring 7, which is not coil bound, extending from the male ferrule 5 to the head or stop 4. The last turns $7_1$ of the spring are buried in the head 4, which gives perfect anchoring, while the first turn $7_2$ is also held partially in the male ferrule. Such partial holding is not absolutely essential however. The spring is composed of tempered steel, and consequently has a high shear strength. Further, the spring is not coil bound so as not to reduce the flexibility of the cable which must be able to curve. It should be noted however that the spring 7, held between the male ferrule and the head 4 is under slight compression, which improves the resistance of the device.

The female ferrule, on the other hand, takes the form of a sheath provided with a blind orifice 8 having a diameter slightly greater than the largest diameter of the male ferrule 5, this sheath being closed at its end $2_1$ so as to prevent a tool from being inserted. The sheath comprises, in the ordinary way, an internal groove $8_1$ into which a locking member 9, in the form of elastic means such as a split ring or circlips, engages. This ring engages the circular groove $5_2$ of the male ferrule when the male and female ferrules are coupled together. Indeed, when the ferrules are coupled, the truncated cone part $5_3$ of the male ferrule penetrates progressively into the split ring 9 so as to spread it radially until it is juxtaposed with the circular groove $5_2$ of the male ferrule and can then snap radially inwards to lock itslef in the groove $5_2$. In the coupled position, the split ring or circlips 9 is consequently partly in the groove 8, in the sheath and partly in the groove $5_2$ in the male ferrule such that the parts are locked together, the locking being sufficiently strong to avoid the male and female ferrules being uncoupled, even with the aid of a tool.

According to a particular feature of the invention, the female ferrule is sufficiently long so that, in the coupled position, the front part $2_2$ at least partly overlaps the last two turns of the spring 7 so that, even if this spring is not in fact buried in the male ferrule 5 during crimping, it is not possible to insert a tool between the last turn of the spring and the facing rear face $5_4$ of the ferrule to reach the cable. Indeed, the cable is much more vulnerable than the tempered steel spring and this is the reason why the female ferrule should overlap slightly with the spring to prevent thieves from being able to reach the cable to cut it.

Figure 2:
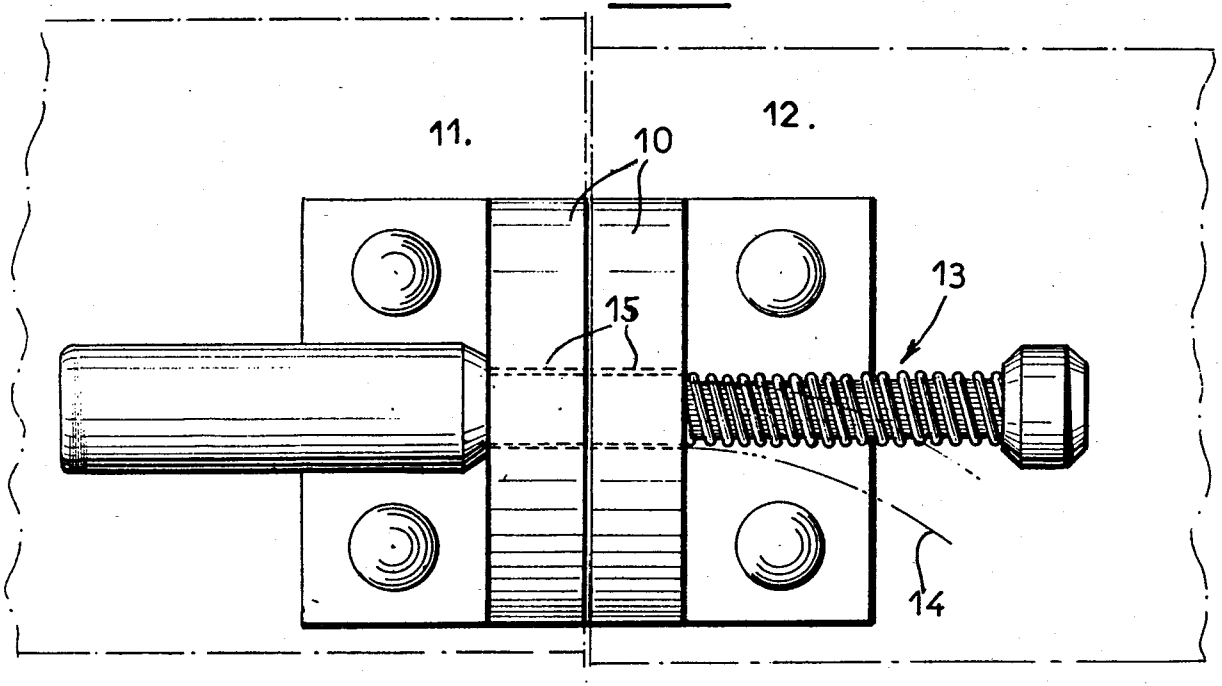
FIG. 2 is a plan view of the same device installed to couple the handles of two doors of a container or wagon.

According to a feature of the invention, as shown in FIG. 2, the cable 3 is sufficiently long so that after insertion in the handles 10 of the two doors 11 and 12, a sufficient length of cable is left for it to be deformed by curving as shown in broken lines at 14, the flexibility of the cable thus avoiding the breakage of the seal device as described heretofore. Indeed, its flexibility makes the cable impervious to most tools so that if a tube is fitted over the head 4, it is impossible to wrench it off, since the cable bends without breaking.

In summary, the device according to the invention is not only an easy to use seal device, but also is practically invulnerable to the tools usually used by thieves, for example wire cutters or pincers. In fact, the device can only be cut using a large bolt cutter which is, difficult to hide and which, once again, will certainly put off malefactors.

As appears from the features referred to above, the male member comprising the cable, the male ferrule and the head, is engaged in the handles 10 and 11 of the doors of the wagon or container, the head 4 having a greater diameter than the orifice 15 provided in the handles, so as to form a rear stop. After this insertion, the male ferrule is assembled with the female ferrule by simply inserting the ferrule 5 in the sheath 2 until the split ring or circlips 9 is locked into the circular groove $5_2$ of the male ferrule. This assembled position is shown in the accompanying FIGS. 1 and 2. In this position, the seal device is operational and can only be withdrawn when the container has arrived, using a bolt cutter, because of the existence of the non-coil bound coil spring of tempered steel.

Of course, the invention is not limited to the embodiment described above by way of example, and variants can be designed without departing from the scope of the invention which is defined in the appended claims.

I claim:

1. A seal device applicable, especially to closure means for the doors of wagons, trucks, trailers, containers and the like, comprising a male part and a female part, said male part comprising an elongated shank having first and second ends, protuberant stop means at said first end for preventing withdrawal of said shank from said closure means by said first end, and a male ferrule on said second end having smaller lateral dimensions than said stop means thereby allowing insertion of said shank in said closure means by said second end, said female part having a socket for reception of said male ferrule, and said device including locking means for cooperating with said male ferrule and said socket to couple said male and female parts within said socket when said male ferrule is inserted in said socket, whereby said female part prevents withdrawal of said shank from said closure means, characterized in that said shank comprises a metal cable and a coil spring surrounding said cable from said stop means to said male ferrule, said spring having close but non-coil bound turns.

2. A seal device as claimed in claim 1, characterised in that said coil spring is held between said stop means and said male ferrule under compression.

3. A seal device as claimed in claim 1 characterised in that said cable is compacted at said first end and said stop means comprises a head moulded thereon, said coil spring having at least one turn buried in said head.

4. A seal device as claimed in claim 1, characterised in that said male ferrule is crimped on said cable at said second end, the crimp presenting a polygonal outer section.

5. A seal device as claimed in claim 4 characterised in that said crimp is two to four times as long as the diameter of said cable.

6. A seal device as claimed in claim 4 characterised in that the pull-off strength of said crimp is less than the tensile strength of said cable, whereby said male ferrule will pull off said cable and stay captive in said socket without the cable breaking when traction is applied between said cable and said female part.

7. A seal device as claimed in claim 1, characterized in that said socket presents a blind recess for receiving said male ferrule, said recess being longer than said male ferrule whereby said socket overlaps at least two end turns of said cable when the male and female parts are coupled together.

8. A seal device as claimed in claim 1, assembled with said closure means to prevent said doors being opened, characterised in that said shank is substantially longer than said closure means whereby said shank can curve elastically without breaking.

* * * * *